US008845444B1

(12) United States Patent
Hoang

(10) Patent No.: US 8,845,444 B1
(45) Date of Patent: Sep. 30, 2014

(54) GOLF TRAINING AID

(71) Applicant: Ben Hoang, Calgary (CA)

(72) Inventor: Ben Hoang, Calgary (CA)

( * ) Notice: Subject to any disclaimer, the term of this patent is extended or adjusted under 35 U.S.C. 154(b) by 0 days.

(21) Appl. No.: 14/106,487

(22) Filed: Dec. 13, 2013

(51) Int. Cl.
*A63B 69/36* (2006.01)

(52) U.S. Cl.
CPC ..... *A63B 69/3608* (2013.01)
USPC ..... 473/208; 473/215; 473/216

(58) Field of Classification Search
USPC ..... 473/207, 208, 211, 215, 216
See application file for complete search history.

(56) References Cited

U.S. PATENT DOCUMENTS 3,442,513 A * 5/1969 Fisher et al. ..... 473/208
3,677,551 A * 7/1972 Schaus ..... 473/208
4,134,589 A * 1/1979 Arena ..... 473/208
5,303,927 A * 4/1994 Perry et al. ..... 473/215
6,620,052 B2 * 9/2003 Piatt ..... 473/208
2001/0046904 A1 * 11/2001 Arvanitis, Jr. ..... 473/208
2003/0134685 A1 * 7/2003 Piatt ..... 473/208
2012/0264535 A1 * 10/2012 O'brien ..... 473/215

* cited by examiner

*Primary Examiner* — Raleigh W Chiu
(74) *Attorney, Agent, or Firm* — Fish & Richardson P.C.

(57) ABSTRACT

A golf swing training device constructed of flexible material that stretches when deployed and that provides feedback to a user during golf swing execution regarding vertical head movement and shoulder movement. The device includes a collar portion, a first tension strap, and a second tension strap. The first tension strap includes a first extension portion being adapted to be disposed along a front of the user from the collar portion down toward a waist of the user and a second extension portion that is adapted to extend from the waist at the user's front to the ground at a predetermined angle. A second tension strap includes a second attachment means at one end and a third attachment means at a second end. The second attachment means is adapted for attachment to the first tension strap at the user's waist area.

9 Claims, 6 Drawing Sheets

GOLF TRAINING AID

TECHNICAL FIELD

The subject matter of this disclosure is related to golf training devices.

BACKGROUND

Golf is a popular sport played by many people around the world of all ages and skill levels. While golf can be enjoyed by anyone, golf is nevertheless a game of skill that requires practice and repetition to reach one's potential. Indeed, the pursuit of lower scores through improved swing mechanics and better "touch" or "feel" for the game is one of the most gratifying aspects of golf. Golfers work on their games in a number of ways such as playing frequent rounds of golf, spending time at the driving range and short-game practice areas, reading literature regarding swing mechanics and mental strategies, and receiving lessons from experienced golfers and golf professionals. Some golfers' practice is facilitated by various training aids that encourage proper swing mechanics.

SUMMARY

The subject matter of this disclosure relates to golf training aids. In general, in one aspect, a training device is disclosed that includes a collar portion sized for placement around a neck of a user, and a first tension strap coupled at one end to the collar portion and including a first attachment means at a second end for attachment to ground. The first tension strap includes a first extension portion being adapted to be disposed along a front of the user from the collar portion down toward a waist of the user and a second extension portion that is adapted to extend from the waist at the user's front to the ground at a predetermined angle. A second tension strap includes a second attachment means at one end and a third attachment means at a second end. The second attachment means is adapted for attachment to the first tension strap at the user's waist area. The third attachment means is adapted for attachment of the second tension strap to ground. The training device is configured such that during swing execution the first and second tension straps provide feedback to the user when a head of the user moves up or down while simultaneously enabling the user to complete the swing without interference from either the first or second tension straps.

Embodiments of the subject matter can include one or more of the following features. The collar portion can include a halo that includes a padded portion in an area adjacent to a user's neck. The first and second tension straps can be elastic. The first and third attachment means can include stakes or spikes.

In some implementations, the training device includes a shoulder portion including a first shoulder cuff and a second shoulder cuff. A third tension strap can couple the first and second shoulder cuffs along a back of the user. A foot portion and a fourth tension strap can also be included. The fourth tension strap can be adapted for coupling to the first shoulder cuff that is positioned on a leading shoulder of a user and extend to the foot portion that is coupled to a user's opposing foot. The fourth tension strap can be adapted for extending across the user's chest and abdomen, wrapping around the user's upper leg and lower leg before attaching to the foot portion. The foot portion can be a cuff. The third and fourth tension straps can be adapted to provide feedback to the user during golf swing execution related to shoulder turn.

In some implementations, the training device can further include a belt portion at a waist of the user and a proximity tension strap coupled at the belt portion and to a junction formed between the first and second tension straps so as to maintain a portion of the first tension strap that is positioned down a front of the user between the collar portion and the belt portion in close proximity to a body of the user.

Embodiments of the disclosed subject matter can realize none, one or more of the following advantages. The training device can be easily adjusted to fit any size user and configured to apply a desirable amount of tension to provide optimal feedback to the user. The training device can be deployed for either right-handed or left-handed golfers. The training device can be easily deployed or disassembled for compact storage. For example, the components of the training device can be made to fit within a pouch or other compartment of a standard golf club bag so that the device may be readily accessible wherever the user takes his/her golf bag and clubs.

DESCRIPTION OF DRAWINGS

Like reference symbols in the various drawings indicate like elements.

DETAILED DESCRIPTION

In general, the subject matter disclosed herein describes a training device constructed of a flexible material that can be worn by a user in a manner that resists the user's movement or otherwise provides feedback when the user makes, for example, an improper golf swing. Particularly, the device is configured to provide resistance when the user raises his/her head and does not properly bend his/her waist in accordance with a desired golf swing action. In particular embodiments, the device can also encourage the user to sufficiently rotate her shoulders during the swing. That is, when a user attempts to execute a golf swing with improper mechanics, such as by raising her head during the backswing, the user will feel resistance at one or more locations such as at the user's neck or waist. Likewise, if a user does not properly rotate her shoulders and/or properly lower her leading shoulder during a backswing, then the user will feel tension on the leading shoulder that encourages the user to properly rotate her shoulders during the backswing portion of her swing in a manner that promotes desired swing mechanics. Over time, use of the training device can improve the user's golf swing by creating muscle memory of a proper golf swing through numerous golf swing repetitions while wearing the golf training device and adjusting one's swing so as to reduce the resistance from the device. In some implementations, the golf training aid can be constructed substantially of neoprene, nylon, or other flexible or elastic materials, and/or combinations of these.

Figure 1:
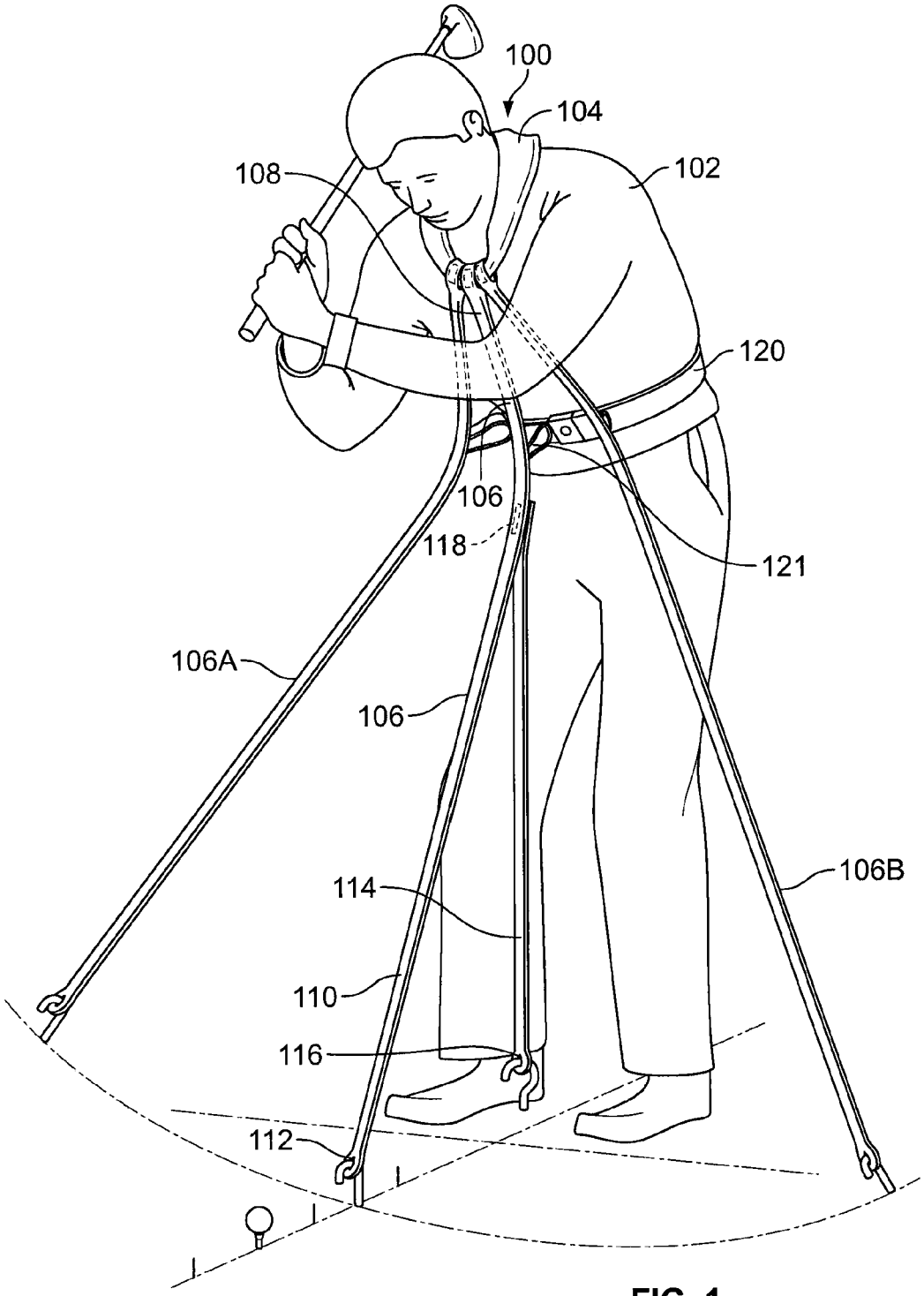
FIG. 1 depicts an example training device being worn by a user in a golf stance.

Referring now to FIG. 1, an example training device 100 is shown being worn by a user 102. In general the training device 100 is configured to be worn primarily along a front side of the user 102. The training device 100 includes a number of different components that interact with each other so as to provide resistive feedback to the user 102 when performing a golf swing. For instance, the training device 100 is shown as including a collar portion 104 that sits around the neck of the user 102, a first tension strap 106 that is coupled at one end to the collar portion 104, and that is coupled at a second end to ground by way of a first attachment means 112. The first tension strap 106 generally resists the user 102 from standing taller during the golf swing and vertically raising her head.

In some implementations, the first tension strap 106 includes a first extension portion 108 and a second extension portion 110. The first extension portion 108 of the first tension strap 106 is shown as extending from the collar portion 104 down to a waist of the user 102. The second extension portion 110 of the first tension strap 106 extends out in front of the user 102 and connects to the ground. In some implementations, the second extension portion 110 of the first tension strap 106 extends from the waist of the user toward the ground at a predetermined angle in order to encourage the user 102 to stand in a proper golf stance. For example, the first tension strap 106 can create resistance at both the waist and neck of the user 102 in order to encourage the user 102 to properly lower her head and to bend her waist at a preferred angle during execution of the golf swing.

The training device 100 also generally includes a second tension strap 114 that is coupled at one end to the second extension portion 110 of the first tension strap 106 in front of the user 102 using a second attachment means 118, and is coupled at a second end to ground using a third attachment means 116. The example training device 100 depicted in FIG. 1 is shown being used by the user 102 that swings right-handed. However, other implementations may also be configured for use by left-handed golfers.

The training device 100 can include a number of different components that can be attached to each other so as to restrict certain motion of the user 102 when executing a golf swing and to promote desired swing mechanics such as the ability to stay vertically level during the swing without raising one's head, and to keep one's waist bent at a proper angle. The first tension strap 106 and second tension strap 114 can be constructed using a flexible material that provides resistance when stretched. As a result, when the user 102 wearing the device 100 executes a golf swing with improper swing mechanics, such as by failing to stay level during the course of the swing or not properly bending at the waist, the flexible material of the first and second tension straps 106 and 114, respectively, can tighten and thereby provide feedback to the user 102 about the improper swing mechanics. The user 102 can then make appropriate corrections in her swing to avoid encountering resistance from the training device 100. By causing the user 102 to avoid resistance during her swing, the training device 100 thereby promotes proper swing mechanics.

In some implementations, a user 102 can at first be trained to use the training device 100 by a swing expert such as a golf teaching professional. Initial training on the training device 100 with a swing expert may be beneficial to the user 102 to ensure that the various components of the training device 100 are optimally or otherwise properly fitted and worn by the user. For instance, depending on the size of a user 102 or variations among particular users' stances in addressing a golf ball, or other particularities of a user's swing, the training device 102 may be configured for individual users 102 to achieve optimal results. As one example, respective elastic properties of the first tension strap 106 and second tension strap 114 can be selected so as to achieve certain feedback characteristics for the user 102. Fit, for example, can be adjusted by shortening one or more of the tension straps that are provided. In some implementations, a highly elastic configuration may be used that does not prevent the user 102 from moving within a range that deviates from ideal swing mechanics, but that nonetheless provides the user 102 with some measure of resistance to the improper motion so that the user 102 can feel such resistance and strive to minimize or eliminate tension from the training device 100. In some implementations, a less elastic configuration may be used in which the first and second tension straps 106, 114 do not stretch an appreciable distance so that the user 102 is prevented from moving outside of proper swing positions an appreciable distance when the training device 100 is properly used. Because the user 102 receives feedback in the form of resistance (for both less and more elastic tension straps 106 and 114), the user's motion is somewhat restricted, so as to encourage/promote proper swing mechanics. For example, the more the user 102 attempts to raise her head or stand upright with her waist not properly bent, the more resistance the user 102 will feel as she executes her golf swing, and hence the more feedback she will receive.

In some implementations, the training device 100 includes the collar portion 104 to fit around the user's 102 neck and to communicate resistive feedback to the user 102 when she raises her head and begins to stand taller during a golf swing. When deployed, the collar portion 104 is coupled to the first tension strap 106 at the front of the collar portion 104 such that the user can feel on her shoulders and around her neck if she begins to raise her head during the swing, which can lead to a number of problems such as "topping" the golf ball and otherwise making inconsistent contact between the club and the ball. The collar portion 104 can be configured to fit snugly around the user's 102 neck without uncomfortably restricting the user 102. The collar portion 104 may be sufficiently taught such that the user 102 can feel when she moves outside of a proper swing position, but is not so restrictive to prevent the user 102 from completing a full turn during the golf swing with proper swing mechanics. The collar portion 104 can be constructed of a substantially rigid ring piece that is lowered over the user's 102 head and that is configured to contact the user's 102 neck and shoulders, and rest on the back of her neck and upper shoulder area. For example, the collar portion 104 can be constructed of a suitable plastic material such as nylon or polyvinyl chloride. For added comfort, a soft padding material may be used to cover the rigid collar material such as foam, neoprene, or a cloth material. For example, the collar portion 104 may include a halo that has a padded portion adjacent to the user's neck. In some implementations, the collar portion 104 may be constructed to wrap around the user's neck without being placed over the user's head. For example, a flexible material may be used to bend around the user's neck, and a fastening means can be used to connect the ends of the collar portion 104 on the front side of the user 102 with the first tension strap 106.

The first tension strap 106 is shown in FIG. 1 as being attached between the collar portion 104 and a point on the ground a determined distance in front of the user 102. When worn by the user 102, the first extension portion 108 of the first tension strap 106 generally extends down the front of the user and to the front of the user's waist. The second extension portion 110 of the first tension strap 106 then extends from the user's waist to ground. The ground end of the first tension strap 106 can include the first attachment means 112 for securing the ground end of the first tension strap 106 to the ground. In some implementations, the first attachment means 112 can be, for example, a loop or other opening at the ground end of the strap 106 that receives a stake, spike, or other object that is configured to be secured to the ground. The first attachment means 112 is operable to secure the first tension strap 106 to the ground so as to withstand the forces incurred while the user 102 performs a golf swing. The first attachment means 112 is also sufficiently secured to the ground to withstand tension forces in the first tension strap 106 resulting from improper swing mechanics such as the user 102 raising her head during a swing or standing with her waist bent at an improper angle, which can exact forces on the first tension strap 106 away from the ground. The first attachment means 112 can be attached to the ground generally near the center of the user's stance between the user's 102 legs and a predetermined distance (e.g., two to three feet) in front of the user 102. The precise positioning of the first attachment means 112 may vary based on a number of factors including the user's height, a preferred posture or stance of the user 102, and the particular club being used with the training device 100. For instance, with longer clubs like a driver, the user 102 may adopt a taller stance and position the first attachment means 112 at a first location (e.g., further) relative to the user 102 whereas with a shorter club such as a pitching wedge, the first attachment means 112 can be positioned at a second location (e.g., closer) to the user 102. The first attachment means 112 can also be positioned so as not to interfere with a swing path of a golf club held by the user 102 during a golf swing. In some implementations, the first attachment means 112 can be positioned relative to a golf ball or golf tee to ensure that the user 102 stands at a proper distance from the golf ball or golf tee.

Opposite the ground end, the first tension strap 106 is attached to the collar portion 104. The first tension strap 106 can be attached to the collar portion 104 near the front of the user's 102 neck near the top of the user's 102 chest. As shown in FIG. 1, the first tension strap 106 is generally fastened at one location to the collar portion 104. An attachment means adapted to receive and secure the first extension strap 106 and the collar portion 104 may be used to couple the first strap 106 to the collar portion 104, such as with a clip, fastener or a metal or plastic piece that binds the ends of each piece together. Alternative attachment configurations between the first strap 106 and the collar portion 104 are also possible. For example, the collar portion 106 can be stitched or glued to the end of the first tension strap 106, or a quick-release connector may be employed for easy connection and disassembly of the first tension strap 106 and the collar portion 104. Other attachment means may be used such as one or more of nylon fabric fasteners, plastic clips, or combinations of these.

The first tension strap 106 may be generally constructed of a flexible and elastic material capable of stretching along its length. The first tension strap 106 can be stretched when worn by the user 102 so as to maintain tension at the user's 102 shoulders and/or neck so that the user can feel increased resistance as she, for example, raises her head and stands too upright during any portion of her golf swing. Suitable materials can include one or more of rubber, polymer-based materials, or fabric, and can be generally elastic.

The second tension strap 114 is configured to be worn by the user 102 by attaching to a point on the second extension portion 110 of the first tension strap 106 and extending substantially vertically down to ground in proximity to the user 102 when the user is in a golf stance. When deployed, the second tension strap 114 generally encourages the user 102 to stand a proper distance away from a golf ball or golf tee such that the second extension portion 110 of the first tension strap 106 extends away from the waist of the user 102 at a proper angle. In some implementations, the second tension strap 114 can create additional resistance to encourage the user 102 to keep her head lowered during a golf swing and to bend her waist at a proper angle.

The second tension strap 114 can be constructed of a flexible material capable of stretching along its length. Suitable materials for the second tension strap 114 include rubber, polymer-based materials, fabric, or any combination of such materials. The first end of the second tension strap 114 can include a second attachment means 118 for fastening the first end of the strap 114 to the first tension strap 106. Some implementations of the second attachment means 118 can include one or more of nylon fabric fasteners, plastic clips, quick-release clips, and the like, or a combination thereof. In some implementations, the second attachment means 118 can non-detachably attach the second tension strap 114 to the first tension strap 106 such as, for example, through use of stitching, gluing, bolting, or the like. The second attachment means 118 is configured to withstand the forces normally experienced by a user 102 executing a golf swing with proper or improper mechanics, without breaking from a located position on the first tension strap 106. A third attachment means 116 is located at a second end of the second tension strap 114 for securing the second end of the second tension strap 114 to the ground. The third attachment means 116 can be implemented similarly or differently from the first attachment means 112 of the first tension strap 106. The third attachment means 116 is configured to hold the second end of the second tension strap 114 near the ground, and may include or be connected to a stake or spike that has been driven into and lodged in the ground. The third attachment means 116 may also be coupled, such as by fastening to, looping around, or hooking onto, any number of other objects that provide stability at or near ground level as the user 102 executes a golf swing.

The third attachment means 116 can be attached to the ground generally near the center of the user's stance between the user's 102 legs. In some implementations, the third attachment means 116 is positioned such that the second tension strap 114 extends vertically down from the first tension strap 106 to ground. In some implementations, the third attachment means 116 is positioned between the feet of the user 102. The precise positioning of the third attachment means 116 may vary based on a number of factors including the user's 102 height, a preferred posture or stance of the user 102, the position along first tension strap 106 at which the second tension strap 114 attaches to the first tension strap 106, and/or the particular club being used with the training device 100. In some implementations, the third attachment means 116 can be positioned relative to a golf ball or golf tee to ensure that the user 102 stands at a proper distance from the golf ball or golf tee. In some implementations, the third attachment means 116 can be positioned relative to the first attachment means 112 to ensure that the user 102 bends her waist at a desired angle, to ensure that the user 102 stands a proper distance from a golf ball or golf tee, or to ensure that the second extension portion 110 of the first tension strap 106 extends to ground at a desired predetermined angle.

Each of the first tension strap 106 and the second tension strap 114 may be constructed of a substantially continuous material along its length, or may be comprised of two or more connected pieces. Each of the first and second tension straps 106 and 114 may also include means for adjusting their respective lengths. For example, a ladderlock strap adjuster can be provided for the user 102 to adjust the lengths of the first and second tension straps 106 and 114 to suit her needs.

In some implementations, the training device 100 can also include a belt 120 that fits around the waist of the user 102. The belt 120 can secure the first tension strap 106 to the user 102 so that the first tension strap 106 remains in proximity to (e.g., pressed against) a front side of the user 102 while the user 102 executes one or more golf swings. In some implementations, the belt 120 can be worn such that a portion of the first tension strap 106 is held between the belt 120 and the user 102 in order to cause the first extension portion 108 of the first tension strap 106 to extend along a portion of the front side the torso of the user 102. In some implementations, the belt 120 can pass through a first pass-through region in the first tension strap 106. The first pass-through region can be of the form of an opening or loop in the first tension strap 106 that allows the belt 120 to pass through, thereby engaging the belt 120 with the first tension strap 106. Any suitable opening capable of receiving the belt 120 and to hold the first tension strap 106 against the user 102 may be used. For example a second layer of flexible material can be stitched at its ends to a first layer of the first tension strap 106 such that the belt 120 can be fed through a gap between the stitched ends. In some implementations, the second attachment means 118 at the first end of the second tension strap 114 may also be configured to attach to the belt 120 near the user's waist rather than at a point along the first tension strap 106 that is in front of the user 102.

In some implementations, the training device 100 can also include a proximity tension strap 121 that is attached to the belt 120 at one end and attached to the first tension strap 106 at a second end. In some implementations, the second end of the proximity tension strap 121 is attached to a junction of the first tension strap 106 and the second tension strap 114. The proximity tension strap 121 can be positioned such that the junction of the first tension strap 106 and the second tension strap 114 is a desired distance away from the user 102. For example, the proximity tension strap 121 can be of a short length, and positioned such that the junction of the first tension strap 106 and the second tension strap 114 is within close proximity to the body of the user 102. As another example, the proximity tension strap 121 can be positioned such that the first extension portion 108 of the first tension strap 106 is positioned down the front of the user 102 in close proximity to the user 102. The proximity tension strap 121 may be generally constructed of a flexible or elastic material capable of stretching along its length. Suitable materials can include one or more of rubber, polymer-based materials, or fabric, and can be generally elastic. In some implementations, the proximity tension strap 121 can be implemented as a separate strap from the first and second tension straps 106 and 114. In some implementations, the proximity tension strap 121 can be implemented as a portion of the first tension strap 106 that extends between the user 102 and the junction of the first tension strap 106 and the second tension strap 114. In some implementations, the proximity tension strap 121 can be implemented as a flexible portion of the belt 120 that attaches to the first tension strap 106, the second tension strap 114, or both.

In the example depicted in FIG. 1, the belt 120 is positioned such that the first tension strap 106 creates an angle at the user's waist. In some implementations, a predetermined angle of the first tension strap 106 can be selected such that the user 102 bends her waist at a proper angle during a golf swing. The training device 100 can be configured such that if the user 102 does not bend her waist at a proper angle, the first tension strap 106 will create resistance in order to encourage the user 102 to bend her waist at the proper angle. In some implementations, the belt 120 can be positioned at other places on the body of the user 102, such as at the user's hips. In some implementations, rather than using a belt to create the angle in the first tension strap 106, the angle can be created through other means. For example, the first tension strap 106 can attach to the user 102 through use of a jacket, vest, or shirt. For example, a portion of the first tension strap 106 can attach to a vest worn by the user 102 in order to create the angle formed by the first extension portion 108 and the second extension portion 110 of the first tension strap 106.

In some implementations, the training device 100 can include additional training tension straps anchored to ground. For example, the training device 100 can include a right tension strap 106A and a left tension strap 106B. Both the right tension strap 106A and the left tension strap 106B are anchored to the ground at one end and anchored to the collar portion 104 at an opposite end. The right and left tension straps 106A and 106B can provide extra stability for the training device 100 to ensure that the user 102, for example, does not improperly raise her head during a golf swing. Similar to the first tension strap 106, the right and left tension straps 106A and 106B can each include an upper extension portion that is in close proximity to the body of the user and a lower extension portion that extends to ground. The right and left tension straps 106A and 106B can be anchored to ground in a manner similar to those described above for the first tension strap 106 and the second tension strap 108.

Figure 2:
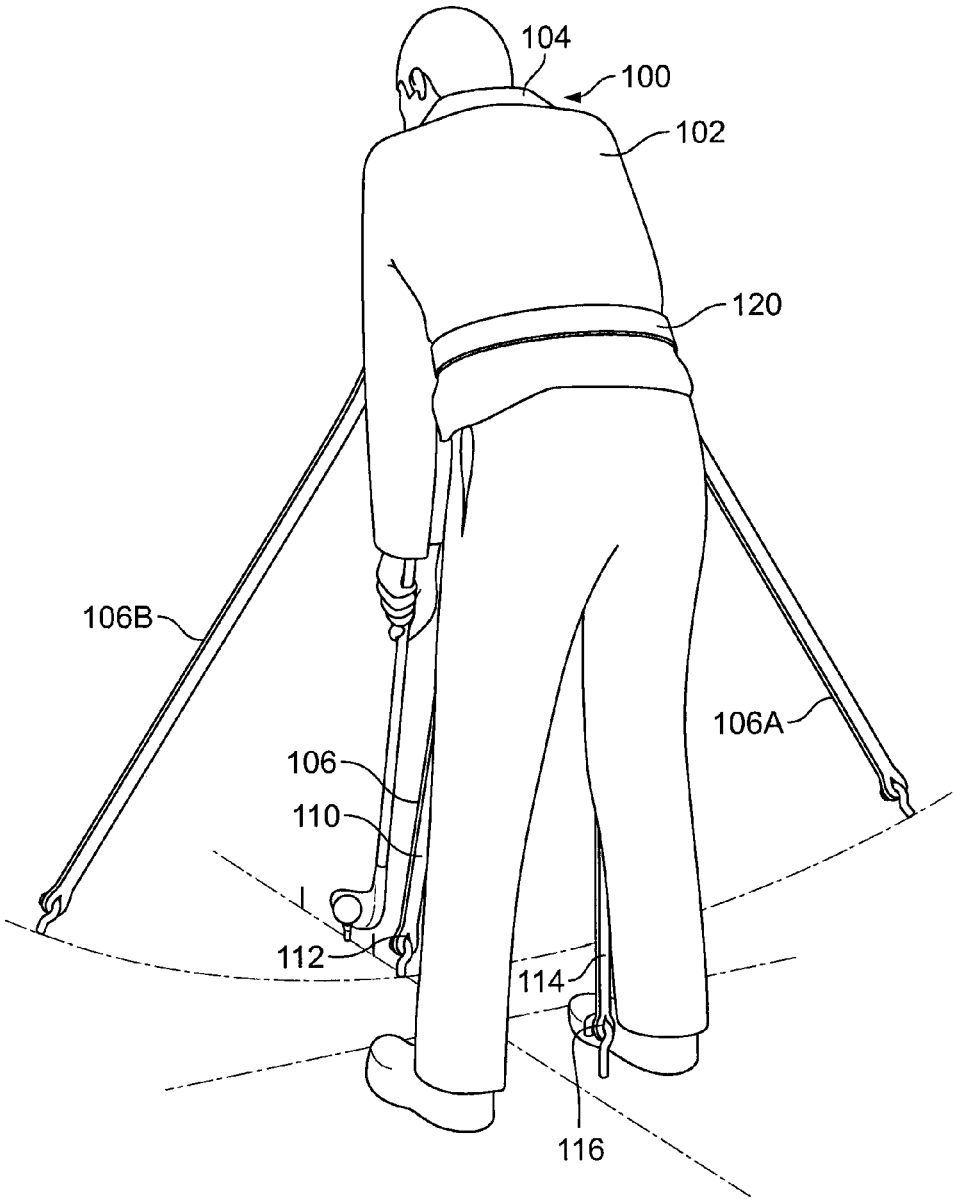
FIG. 2 depicts a rear view of the example training device of FIG. 1 being worn by the user.

FIG. 2 shows a rear view of the example training device 100. As described above with respect to FIG. 1, the training device 100 can include a first tension strap 106, a second tension strap 114, and a collar portion 104. The training device 100 can additionally include a belt 120 for securing a portion of the first tension strap 106 within close proximity to the body of a user 102. The device 100 is configured to be worn by the user 102 to promote proper golf swing mechanics including minimal vertical movement (i.e., not raising one's head), and a proper waist angle during a golf stance.

Figure 3:
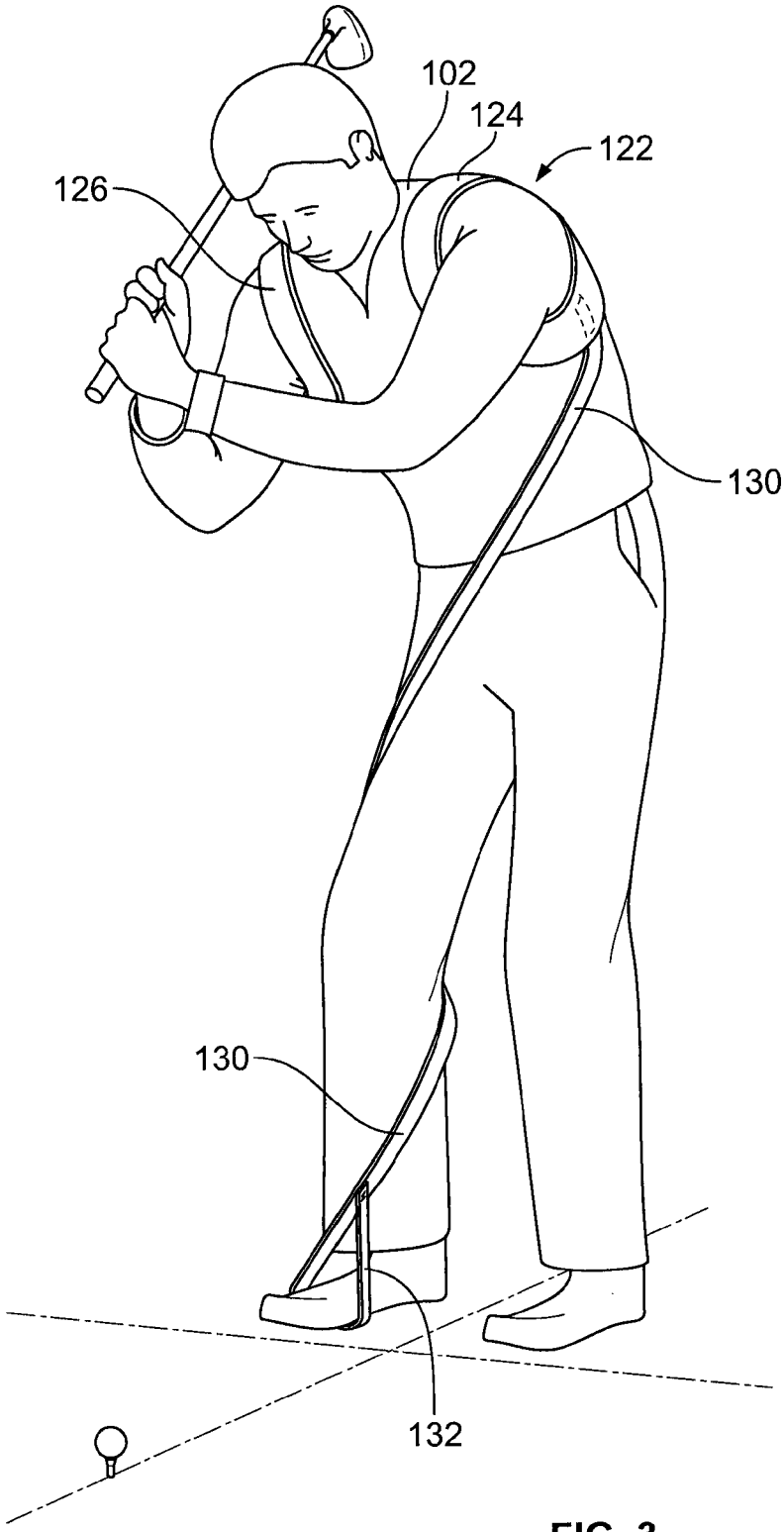
FIG. 3 depicts an example shoulder training assembly being worn by a user.
Figure 4:
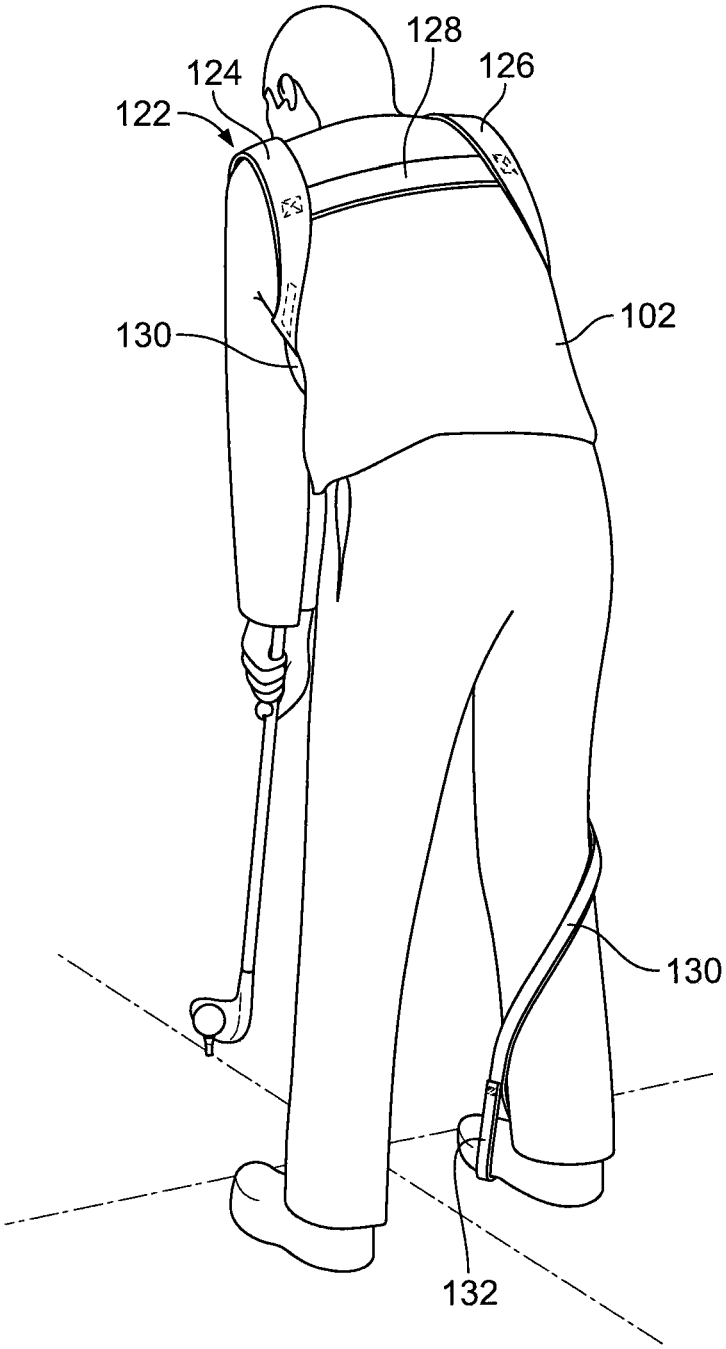
FIG. 4 depicts a rear view of the example shoulder training assembly of FIG. 3 being worn by the user.

With reference to FIGS. 3 and 4, an example shoulder training assembly 122 that can be used to improve a user's shoulder turn when making a golf swing is shown. The shoulder training assembly 122 can be used as part of the training device 100 as described above with respect to FIGS. 1 and 2.

FIGS. 3 and 4 show the user 102 wearing the shoulder training assembly 122 that includes a shoulder portion having a first shoulder cuff 124 and a second shoulder cuff 126, a third tension strap 128 coupling the first and second shoulder cuffs 124 and 126, a foot portion 132, and a fourth tension strap 130. In some implementations, the shoulder training assembly 122 can be worn and used by the user 102 with or without the training device 100 described above. For instance, if a user 102 is particularly interested in practicing the shoulder turn aspects of swing mechanics, then the user 102 could use the shoulder training assembly 122 by itself or with a subset or all of the components of the training device 100.

The first shoulder cuff 124 fits around the user's 102 leading shoulder (left shoulder for a right-handed golfer, right shoulder for a left-handed golfer), and the second shoulder cuff 126 fits around the user's 102 opposite shoulder. The shoulder cuffs 124 and 126 can each slide up a respective arm of a user, with a top portion of the shoulder cuffs 124, 126 lying over the user's 102 respective shoulders and circling under and around the user's 102 respective arms. Each of the first shoulder cuff 124 and second shoulder cuff 126 can be constructed of a soft, flexible material such as a suitable fabric or neoprene rubber. The first and second shoulder cuffs 124 and 126 are coupled by a third tension strap 128 that runs along the back of the user 102 when deployed. The third tension strap 128 may be stitched, glued, or otherwise connected to the first and second shoulder cuffs 124, 126. In some implementations, the third tension strap 128 may be removably attached by using, for example, buttons, clips, or a nylon fabric fastener. As the user wears the shoulder training assembly 122, the third tension strap 128 is pulled taught between the user's 102 shoulders to help keep the user's shoulders together and pulled back in a proper golf swing position. The third tension strap 128 also facilitates the user's 102 efforts to rotate the shoulders together during a golf swing.

The shoulder training assembly 122 can also include a fourth tension strap 130. When deployed, the fourth tension strap 130 can ensure that the user 102 properly rotates her shoulders during a backswing of a golf swing by creating resistance on the user's 102 leading shoulder. As the fourth tension strap 130 is stretched, tension builds in the strap 130, and as one end of the strap 130 can be attached to the first shoulder cuff 124, the tension is communicated to the user's 102 leading shoulder. The tension in the fourth tension strap 130 reduces as the user 102 enters a backswing of a golf swing, thereby encouraging the user 102 to properly rotate her shoulders during the backswing. If the user 102 does not properly rotate her shoulders during the backswing, the user receives feedback from the should training assembly 122 in the form of resistance imparted on the leading shoulder of the user 102 by the shoulder cuff 124 and the fourth tension strap 130. In some implementations, reduction of resistance imparted on the leading should of the user 102 as the user 102 properly rotates her shoulders during the backswing indicates to the user 102 that she is properly rotating her shoulders during the backswing.

The fourth tension strap 130 can extend from the first shoulder cuff 124, down a side of the user 102 (i.e., left side for a right-handed golfer, right side for a left-handed golfer), then across the chest and abdomen of the user 102, and wrap none, one, or more times around the user's back leg (i.e., right leg for a right-handed golfer, left leg for a left-handed golfer). For example, the fourth tension strap 130 can wrap once around the user's 102 upper leg and once around the user's 102 lower leg. In the implementation shown, the fourth tension strap 130 is attached to the first shoulder cuff 124 at the bottom of the first shoulder cuff 124. In some implementations, the fourth tension strap 130 can be attached to the first shoulder cuff 124 at other portions along the first shoulder cuff 124. For example, the fourth tension strap 130 can attach to the front of the first shoulder cuff 124 such that the fourth tension strap 130 extends diagonally across the chest of the user 102.

The second end of the fourth tension strap 130 can terminate at or near the user's 102 back foot. For example, as shown in FIGS. 3 and 4, the fourth tension strap 130 includes a foot portion 132 in the form of a loop at its end that receives the user's 102 back foot in order to secure the second end of the fourth tension strap 130 near ground and to resist the tension strap 130 from releasing as the user 102 rotates during a golf swing. The foot portion 132 can also be implemented by other means to secure the second end of the fourth tension strap 130 to the user's back foot or to ground in proximity to the position of the user's back foot such as the means described above with respect to the first and third attachment means 112 and 116, respectively. The foot portion 132 can be a cuff in some implementations.

In some implementations, the fourth tension strap 130 can also be configured to be worn by the user 102 in a manner that extends from the user's 102 leading shoulder, across the user's 102 back, and to then wrap around the user's 102 upper and lower leg opposite the user's 102 leading shoulder. In some implementations, the shoulder training assembly 122 can be configured to encourage proper shoulder rotation during a forward swing portion of a golf swing, for example, by reducing resistance as the user 102 rotates her shoulders during the forward swing. In each of the described implementations of the shoulder training assembly 122, the third tension strap 128 and fourth tension strap 130 are each configured to provide feedback to the user related to shoulder turn during a golf swing.

The third and fourth tension straps 128 and 130 may each be generally constructed of a flexible or elastic material capable of stretching along its length. Suitable materials can include one or more of rubber, polymer-based materials, or fabric, and can be generally elastic.

Figure 5:
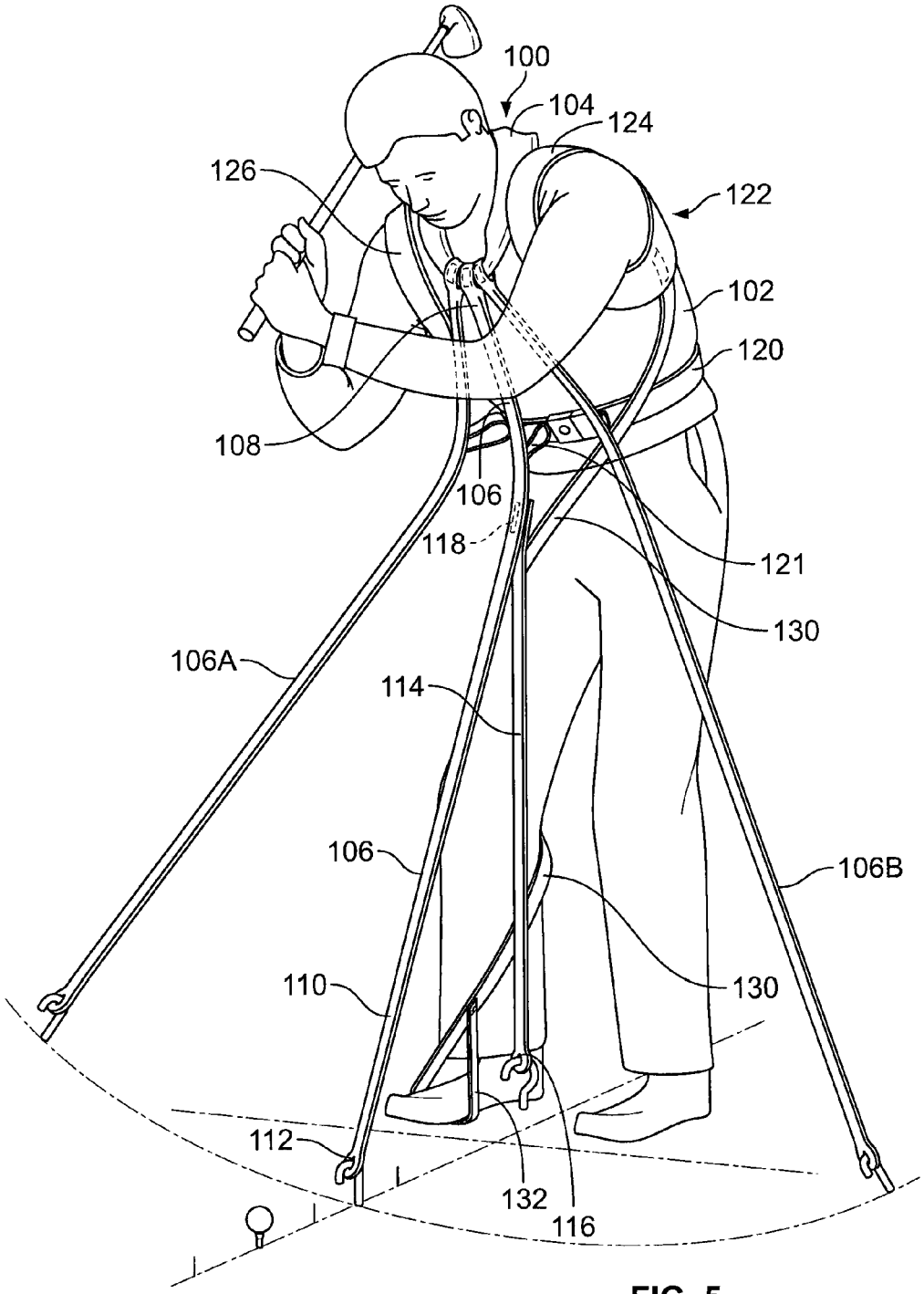
FIG. 5 depicts an example training device including an example shoulder training assembly being worn by a user.
Figure 6:
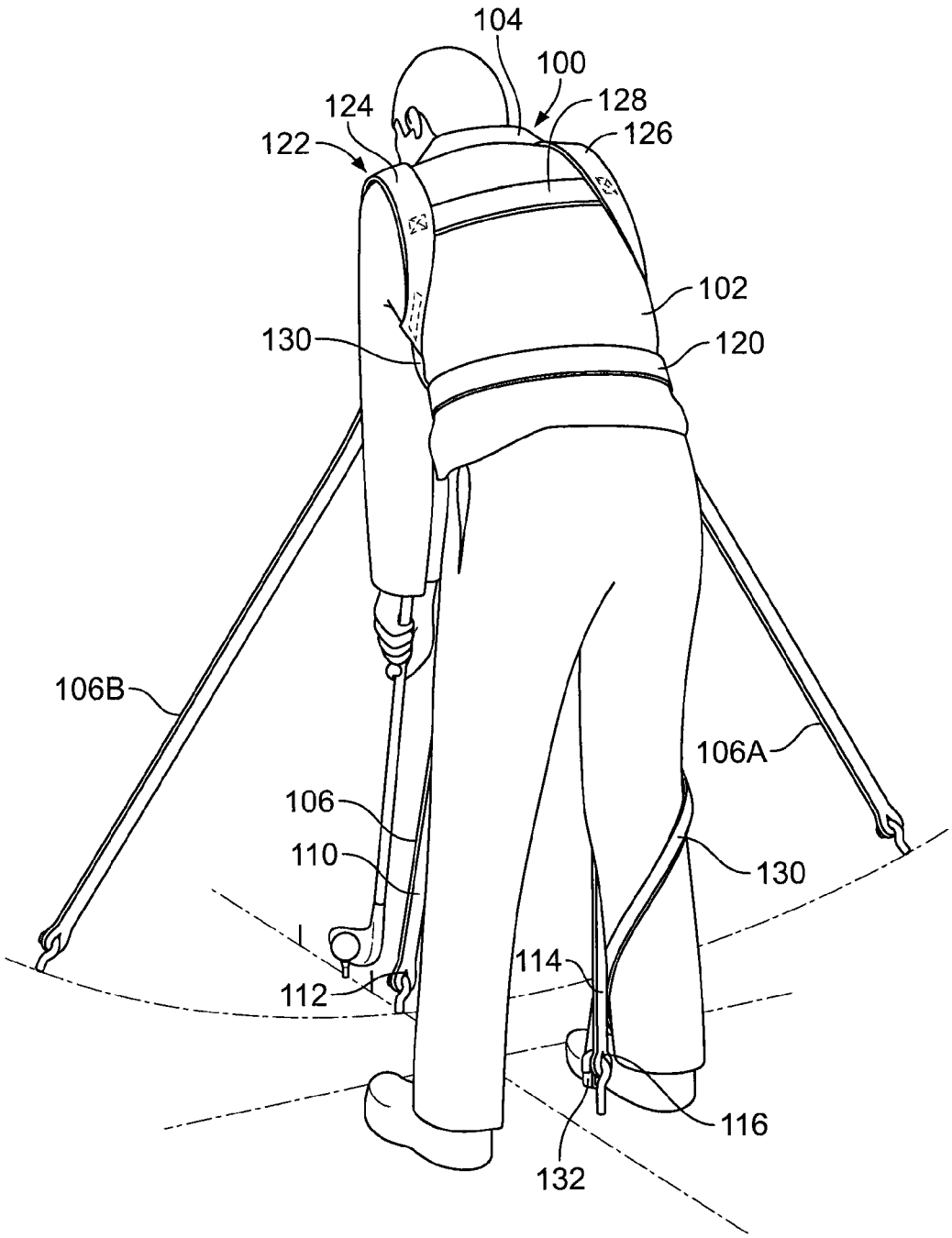
FIG. 6 depicts a rear view of the example training device including the example shoulder training assembly being worn by the user.

Referring now to FIGS. 4 and 5, a user 102 is shown utilizing both the training device 100 and the shoulder training assembly 122 at the same time. The training device 100 and shoulder training assembly 122 are configured such that both can be worn by a single user simultaneously without one apparatus interfering with the operation of the other. By using both the training device 100 and the shoulder training assembly 122 at the same time, the user 102 is able to work on multiple aspects of her golf stance and golf swing simultaneously. For example, while the user 102 is executing a golf swing, the training device 100 provides resistive feedback to the user 102 to encourage the user 102 to keep her head lowered and her waist bent at a proper angle, while the shoulder training assembly 122 provides resistive feedback to the user 102 to encourage the user 102 to properly rotate her shoulders during a backswing of the golf swing.

In some implementations, rather than including the foot portion 132, the fourth tension strap 130 can include an attachment means similar to the first and third attachment means 112 and 116 for attaching the fourth tension strap 130 to ground. In some implementations, the attachment means of the fourth tension strap 130 can be positioned relative to the first attachment means 112 or the third attachment means 116 to ensure that the user 102 stands in a proper position with respect to the first attachment means 112 or the third attachment means 116. In some implementations, the attachment means of the fourth tension strap 130 can be positioned relative to a golf ball or golf tee to ensure that the user 102 stands in a proper position with respect to the golf ball or golf tee.

In some implementations, one or more portions of the training device 100 can engage or interact with one or more portions of the shoulder training assembly 122. For example, the belt 120 can be used to secure a portion of the fourth tension strap 130 against the abdomen of the user 102. This can be achieved, for example, by positioning a portion of the fourth tension strap 130 between the belt 120 and the body of the user 102. As another example, one or both of the first and second shoulder cuffs 124 and 126 can be attached to the collar portion 104 of the training device 100 to ensure a proper fit for the user 102 or to prevent portions of the training device 100 or shoulder training assembly 122 from sliding out of place.

In some implementations, the training device 100 and/or the shoulder training assembly 122 can be used to teach proper motion and techniques for activities other than golf. For example, the training device 100 and/or the shoulder training assembly 122 can be configured for use in teaching proper baseball bat swinging techniques, proper cricket bat swinging techniques, or proper tennis stroke techniques.

A number of embodiments of the invention have been described. Nevertheless, it will be understood that various modifications may be made without departing from the spirit and scope of the invention. Accordingly, other embodiments are within the scope of the following claims.

What is claimed is:

1. A training device comprising:

a collar portion sized for placement around a neck of a user;

a first tension strap coupled at one end to the collar portion and including a first attachment means at a second end for attachment to ground, the first tension strap including a first extension portion being adapted to be disposed along a front of the user from the collar portion down toward a waist of the user and a second extension portion that is adapted to extend from the waist at the user's front to the ground at a predetermined angle; and a second tension strap including a second attachment means at one end and a third attachment means at a second end, wherein:

the second attachment means is adapted for attachment to the first tension strap at the user's waist area, the third attachment means is adapted for attachment of the second tension strap to ground, and during swing execution the first and second tension straps provide feedback to the user when a head of the user moves up or down while simultaneously enabling the user to complete the swing without interference from either the first or second tension straps.

2. The training device of claim 1 wherein the collar portion includes a halo including a padded portion in an area adjacent to a user's neck.

3. The training device of claim 1 wherein the first and second tension straps are elastic.

4. The training device of claim 1 wherein the first and third attachment means are stakes or spikes.

5. The training device of claim 1 further including:

a shoulder portion including a first shoulder cuff and a second shoulder cuff;

a third tension strap coupling the first and second shoulder cuffs along a back of the user;

a foot portion; and a fourth tension strap adapted for coupling to the first shoulder cuff that is positioned on a leading shoulder of a user and extend to the foot portion that is coupled to a user's opposing foot.

6. The training device of claim 5 wherein the fourth tension strap is adapted for extending across the user's chest and abdomen, wrapping around the user's upper leg and lower leg before attaching to the foot portion.

7. The training device of claim 6 wherein the foot portion is a cuff.

8. The training device of claim 7 wherein the third and fourth tension straps are adapted to provide feedback to the user during golf swing execution related to shoulder turn.

9. The training device of claim 1 further including a belt portion at a waist of the user and a proximity tension strap coupled at the belt portion and to a junction formed between the first and second tension straps so as to maintain a portion of the first tension strap that is positioned down a front of the user between the collar portion and the belt portion in close proximity to a body of the user.

* * * * *